US011668182B1

(12) United States Patent
Boudjatit et al.

(10) Patent No.: US 11,668,182 B1
(45) Date of Patent: Jun. 6, 2023

(54) DETERMINING SWEET SPOTS AND RANKING OF A BASIN

(71) Applicant: Saudi Arabian Oil Company, Dhahran (SA)

(72) Inventors: Mohammed Boudjatit, El Kennar (DZ); Ihab S. Mahmoud Aly, Dhahran (SA); Mustafa A. Basri, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/535,211

(22) Filed: Nov. 24, 2021

(51) Int. Cl.
*E21B 47/003* (2012.01)
*E21B 47/10* (2012.01)

(52) U.S. Cl.
CPC ..... *E21B 47/003* (2020.05); *E21B 47/10* (2013.01)

(58) Field of Classification Search
CPC ..... E21B 47/003; E21B 47/10
See application file for complete search history.

(56) References Cited

U.S. PATENT DOCUMENTS 9,910,938 B2 3/2018 German et al.
10,718,208 B2 7/2020 Chorn
2010/0161292 A1* 6/2010 Shook ..... E21B 43/00 703/2
2011/0320128 A1* 12/2011 Shook ..... E21B 47/11 166/250.12
2013/0132052 A1* 5/2013 Hogg ..... G06T 17/05 703/6
2015/0226061 A1* 8/2015 Shook ..... E21B 43/20 702/12

OTHER PUBLICATIONS

Asquith, "Reservoir producibility index [RPI] from NMR logs and the analysis of tight oil reservoirs" URTeC 2673849, Unconventional Resources Technology Conference, Jul. 2017, 5 pages.
Chen et al., "Prediction of sweet spots in shale reservoir based on geophysical well logging and 3D seismic data" Energy Exploration & Exploitation, 35(2), Mar. 2017, 147-171, 26 pages.
(Continued)

*Primary Examiner* — Natalie Huls
*Assistant Examiner* — Michael J Singletary
(74) *Attorney, Agent, or Firm* — Fish & Richardson P.C.

(57) ABSTRACT

A method for determining sweet spots in a subterranean formation includes drilling a plurality of wellbores in the subterranean formation using a drill tool; lowering a logging tool in each of the plurality of wellbores to collect measurements; calculating a reservoir quality index parameter for each wellbore of the plurality of wellbores based on petrophysical logs; creating a reservoir quality index map using the petrophysical logs; calculating a linear flow index parameter for each wellbore of the plurality of wellbores based on production data provided by the petrophysical logs; correlating the reservoir quality index parameter and the linear flow index parameter for each wellbore of the plurality of wellbores to locate sweet spots; and ranking a basin based on the located sweet spots and the correlated parameters.

20 Claims, 9 Drawing Sheets

(56) References Cited

OTHER PUBLICATIONS

Heege et al., "Sweet spot identification in underexplored shales using multidisciplinary reservoir characterization and key performance indicators: Example of Posidonia Shale Formation in the Netherlands" Journal of Natural Gas Science and Engineering, Aug. 27, 2015, 558-577, 20 pages.
Jiang et al., "Evaluating producible hydrocarbons and reservoir quality in organic shale reservoirs using nuclear magnetic resonance (NMR) factor analysis" SPE-175893-MS, Society of Petroleum Engineers, Oct. 2015, 9 pages.
Kausik et al., "Novel reservoir quality indices for tight oil" SPE-178622-MS/URTeC: 2154859, Unconventional Resources Technology Conference, Jul. 2015, 10 pages.

* cited by examiner

168

188

208

DETERMINING SWEET SPOTS AND RANKING OF A BASIN

TECHNICAL FIELD

The present disclosure generally relates to methods for determining sweet spots and ranking of a basin, more particularly methods for determining reservoir performance by correlating a reservoir quality index parameter (RQI) and a linear flow parameter (LFP).

BACKGROUND

Understanding the ranking criteria of a basin is critical in the exploration, delineation, and development phase of a hydrocarbon field. It helps to reduce the operational costs associated with well placement, well spacing, the number of drilled wells, stimulation design, and enhancement of hydrocarbon recovery.

Existing approaches determine reservoir performance by considering source rock richness and hydrocarbon volumes in place, without detailed reference to the reservoir properties that affect the fluid flow in the formation.

SUMMARY

This specification describes systems and methods for accurately determining sweet spots and ranking of the basin. In this context, sweet spots are target locations or areas within a reservoir that represents the best production or potential production and identified based on parameters such as a reservoir quality index, a linear flow parameter, and a production performance indicator. This approach takes in consideration the flow behavior and storage capacities in connection with the production data of the wellbore. For example, the reservoir quality index represents overall flow characteristics of a formation and is based on parameters that directly affect the flow of fluids (e.g., permeability and thickness of the sample, initial reservoir pressure, and fluid viscosity) in the formation. The reservoir quality index can be mapped across the basin. The linear flow parameter represents the dynamic flow capacity of a well and can be calculated locally for individual wells based on observed production and bottom-hole flowing pressure data.

A correlation between the reservoir quality index and the linear flow parameter is developed by comparing the value of these two parameters at the individual wells where both are available. This correlation is then used to convert the reservoir quality index map to a reservoir productivity index map with sweet spots identified and basin ranking can be determined based on the reservoir productivity index. Business plans for a reservoir delineation and development can be designed based this information.

In some aspects, a method for determining sweet spots in a subterranean formation includes drilling a plurality of wellbores in the subterranean formation using a drill tool; lowering a logging tool in each of the plurality of wellbores to collect measurements; calculating a reservoir quality index parameter for each wellbore of the plurality of wellbores based on petrophysical logs; creating a reservoir quality index map using the petrophysical logs; calculating a linear flow index parameter for each wellbore of the plurality of wellbores based on production data provided by the petrophysical logs; correlating the reservoir quality index parameter and the linear flow index parameter for each wellbore of the plurality of wellbores to locate sweet spots; and ranking a basin based on the located sweet spots and the correlated parameters.

In some aspects, a method for ranking a basin includes calculating a reservoir quality index parameter for each wellbore of the plurality of wellbores based on petrophysical logs; creating a reservoir quality index map; calculating a linear flow index parameter for each wellbore of the plurality of wellbores based on production data; correlating the reservoir quality index parameter and the linear flow index parameter for each wellbore of the plurality of wellbores to locate sweet spots; and ranking a basin based on the located sweet spots and the correlated parameters.

Embodiments of the method for determining sweet spots and ranking a basin in a subterranean formation can include one or more of the following features.

In some embodiments, the method includes calculating the reservoir quality index parameter and characterizing the formation in each wellbore for permeability, thickness, and pressure. In some cases, the method includes characterizing the formation by taking into effect the flow characteristics of hydrocarbons and measuring fluid viscosity. In some cases, the method includes calculating the reservoir quality index parameter is based on Darcy equation.

In some embodiments, the method includes creating the reservoir quality index map and correlating pore size and density with the permeability of the formation based on the petrophysical logs and scanning electron microscope images.

In some embodiments, the method includes calculating the linear flow index parameter and correlating flow characteristics in the formation by observing the production data and a bottom-hole flowing pressure data. In some cases, the method includes correlating the reservoir quality index parameter and the linear flow index parameter that includes determining potential development opportunities. In some cases, the method includes correlating the reservoir quality index parameter and the linear flow index parameter by ranking the basin. In some cases, the method includes ranking the basin with three main limits such as low, medium, and high as criteria to classify the production performance of the wellbore.

In some embodiments, the method includes calculating the linear flow index parameter and calculating a dynamic flow capacity of the wellbore.

This approach can be implemented in reservoirs by using existing wellbore logging measurements and production data of low-permeability wells (i.e., produced via multiple hydraulically fractured horizontal wells under unconventional resources) where deciding and ranking development opportunities can be risky.

The details of one or more embodiments of these methods are set forth in the accompanying drawings and the description below. Other features, objects, and advantages of these methods will be apparent from the description, drawings, and claims.

DETAILED DESCRIPTION

This specification describes systems and methods for accurately determining sweet spots and ranking of the basin. In this context, sweet spots are target locations or areas within a reservoir that represents the best production or potential production and identified based on parameters such as a reservoir quality index, a linear flow parameter, and a production performance indicator. This approach takes in consideration the flow behavior and storage capacities in connection with the production data of the wellbore. For example, the reservoir quality index represents overall flow characteristics of a formation and is based on parameters that directly affect the flow of fluids (e.g., permeability and thickness of the sample, initial reservoir pressure, and fluid viscosity) in the formation. The reservoir quality index can be mapped across the basin. The linear flow parameter represents the dynamic flow capacity of a well and can be calculated locally for individual wells based on observed production and bottom-hole flowing pressure data.

A correlation between the reservoir quality index and the linear flow parameter is developed by comparing the value of these two parameters at the individual wells where both are available. This correlation is then used to convert the reservoir quality index map to a reservoir productivity index map with sweet spots identified and basin ranking can be determined based on the reservoir productivity index. Business plans for a reservoir delineation and development can be designed based this information.

Figure 1:
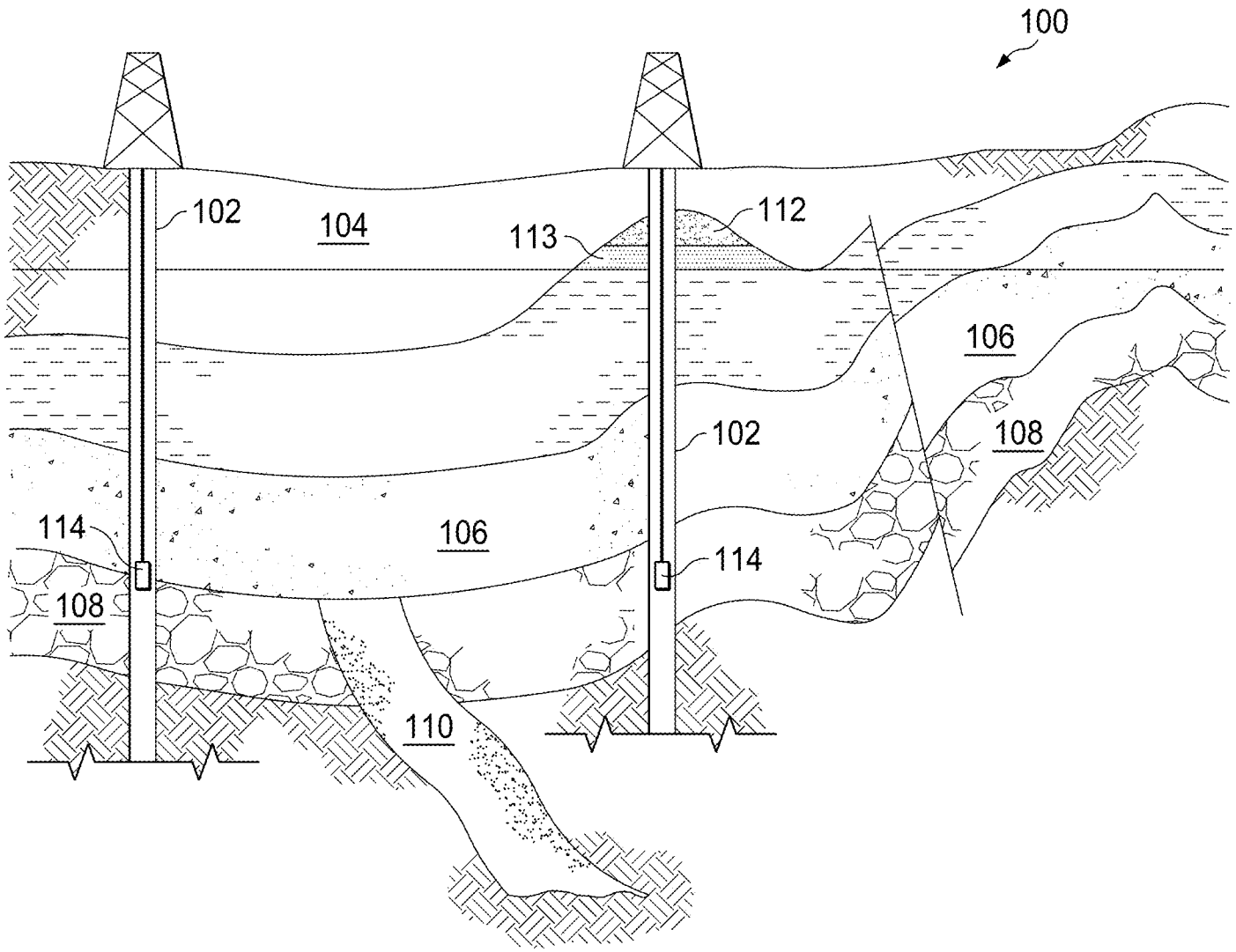
FIG. 1 is a schematic view of a basin.

FIG. 1 is a schematic view of a basin 100. Logging tools 114 deployed in wellbores 102 are being used to measure properties of the subsurface formation of the basin 100 at the wellbores. The subsurface formation includes multiple geological layers and regions 104, 106, 108, 110, 112, 113. At various depths of the formation, the pores in the geological layers are filled with water or other fluids. The content of the geological layers and regions 104, 106, 108, 110, 112, 113 in the basin 100 affect the location of sweet spots and ranking of the basin. For example, oil and gas production from a shale reservoir is the function of porosity, hydrocarbon saturation, and matrix permeability. Because low permeability is inherent in shale reservoirs, horizontal wells are drilled to aid economic production of the hydrocarbon. However, in condensate or oil shale reservoirs, not all the hydrocarbon in place can be produced. Understanding fluid types and volume in shale reservoirs helps to evaluate reservoir quality and estimate hydrocarbon production. Accurate determination of the sweet spots across the basin 100 plays a role in determining the commerciality of the well investment and reducing operational cost, as well as subsurface characterization for other applications.

Figure 2:
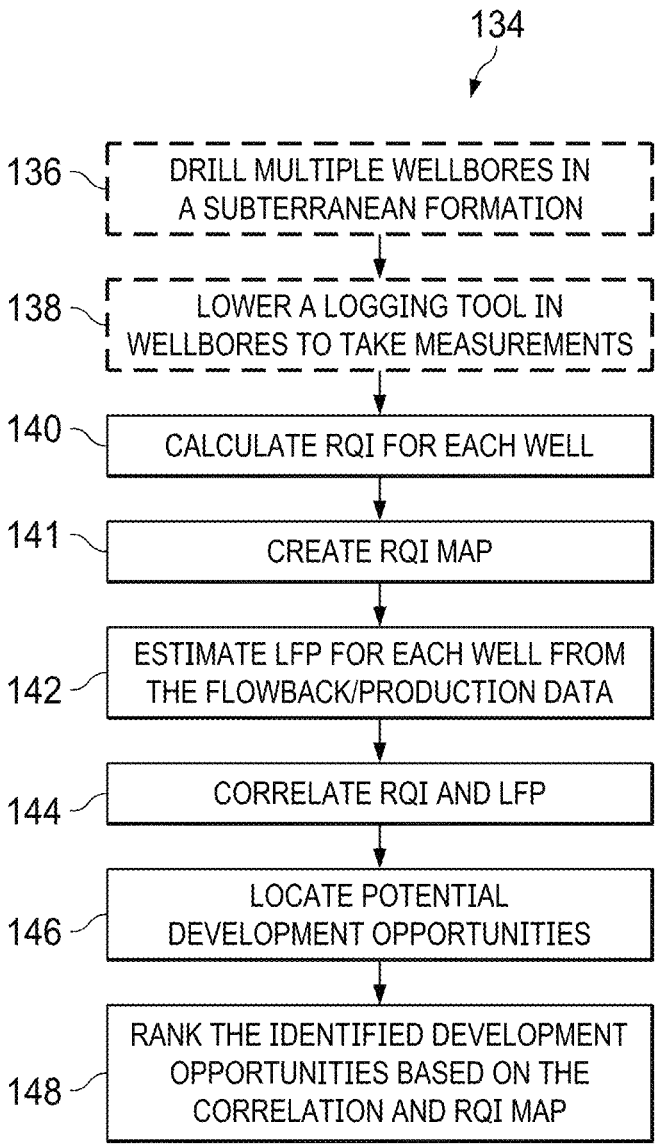
FIG. 2 is a flowchart representing a method for determining sweet spots and basin ranking.

FIG. 2 is a flowchart representing a method 134 for determining sweet spots and basin ranking. The following discussion of the method describes the steps with reference to the basin 100 shown in FIG. 1. In some implementations, the basin 100 can include wells that are planned for the near future, wells being drilled, and/or previously drilled wells. As previously described, this approach identifies development opportunities by correlating reservoir quality index parameters and linear flow parameters calculated from data collected using, for example, wireline logs. The correlation is used to convert the reservoir quality index map to a reservoir productivity index map with sweet spots identified and basin ranking can be determined based on the reservoir productivity index.

In some implementations, wellbores are drilled into in the subterranean formation (step 136). Either during drilling or after drilling, logging is performed to measure static parameters that can affect the flow of hydrocarbons in each wellbore (step 138). For example, a logging tool 114 can be lowered into a wellbore 102 to measure reservoir pressure, fluid viscosity, porosity, permeability, the thickness of the formation, and collect scanning electron microscope images at different locations along the wellbore 102. In some implementations, the method 134 is implemented using previously gathered data and these steps are omitted.

Figure 3:
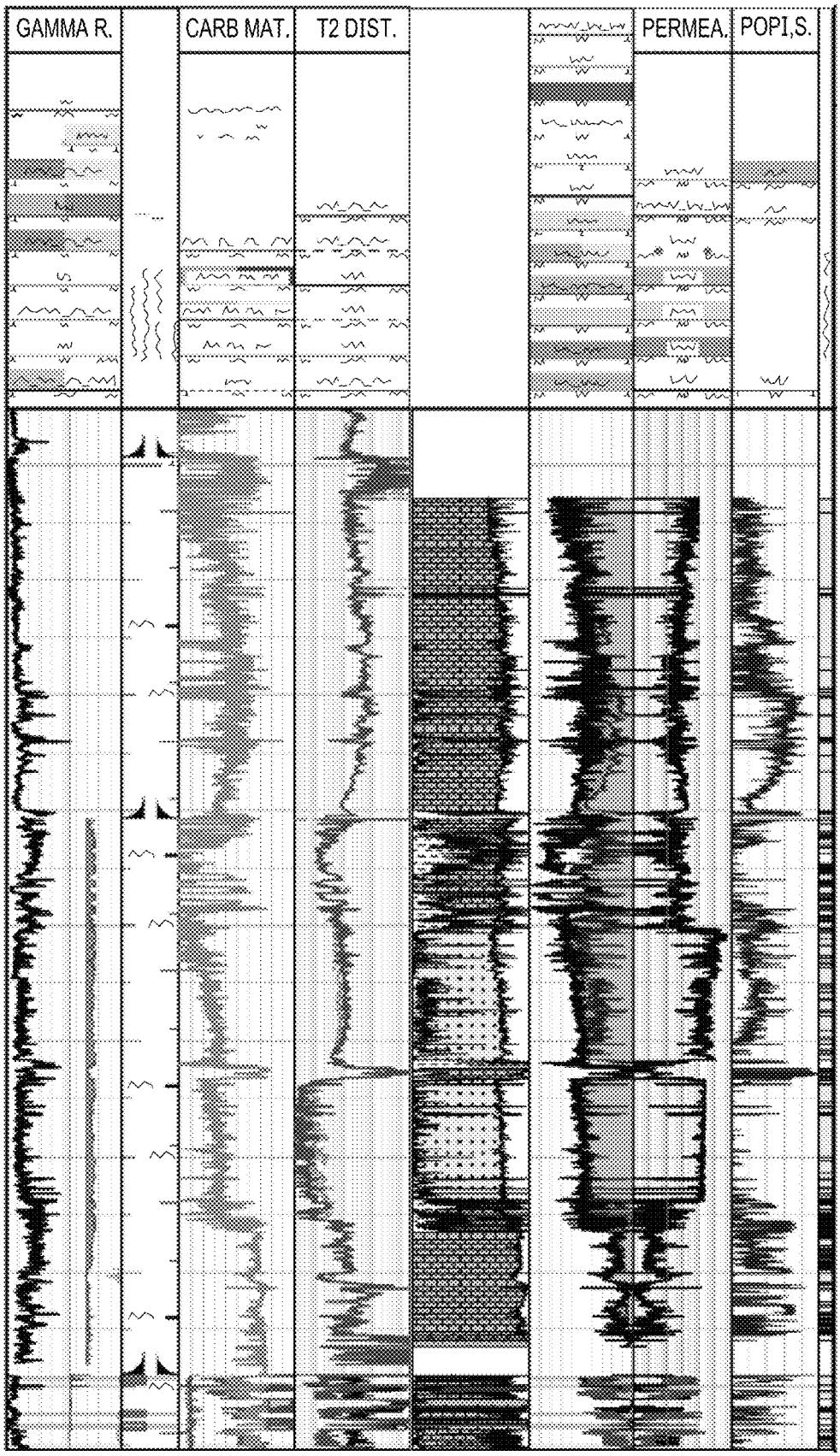
FIG. 3 is an example well log presenting data collected during logging of a wellbore.

FIG. 3 is an example well log 168 presenting data collected during logging of a wellbore 102. As mentioned earlier, well logs 168 present data such as reservoir pressure, fluid viscosity, permeability, and thickness of the formation.

Figure 4A:
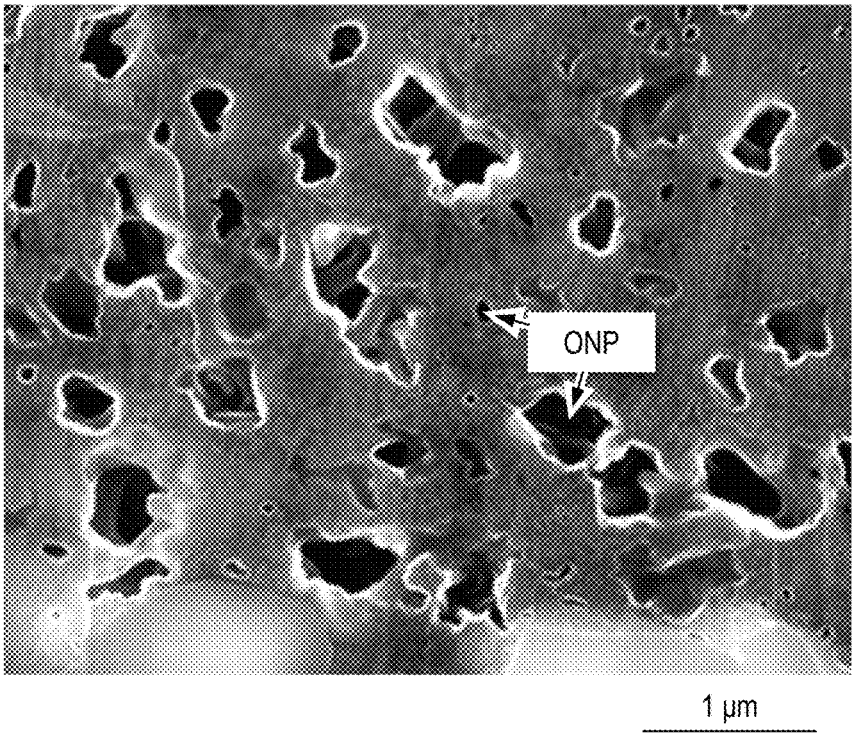
FIGS. 4A-4B illustrate some of the steps of generating formation data.
Figure 4B:
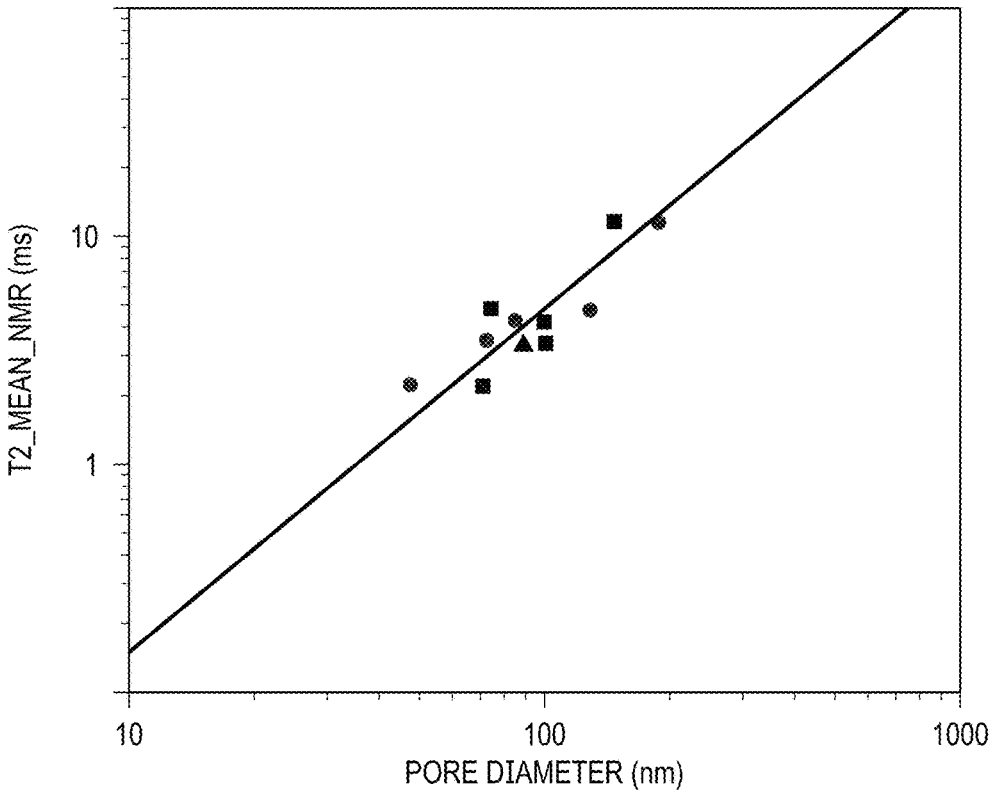

FIGS. 4A and 4B illustrate some of the steps of generating formation data. The well logs include a measured thickness of the formation and calculated reservoir pressure. The reservoir pressure is calculated by calibrating pressure points measured using diagnostic fracture injection testing (DFIT) approach described in "A Collaborative Study on DFIT Interpretation: Integrating Modeling, Field Data, and Analytical Techniques", URTeC: 123, Prepared by M. McClure et al. for presentation at the Unconventional Resources Technology Conference held in Denver, Colo., 22-24 Jul. 2019, and "Analysis of Production Data from Fractured Shale Gas Wells", SPE 131787, by D. M. Anderson et al. presented at the Unconventional Gas Conference held in Pittsburgh, Pa., USA, 23-25 Feb. 2010, incorporated by reference in this disclosure in its entirety. Pore densities can be identified using the scanning electron microscope images 188 collected from the formation (as shown in FIG. 4A). The pores can be characterized in size by extracting their diameter measured in nanometers (nm). The pore diameter is correlated 208 with T2 cutoff measured in milliseconds (ms) to calculate the permeability of the formation (as shown in FIG. 4B).

Referring again to FIG. 2, the data associated with individual wells 102 is then used to calculate the reservoir quality index parameter for each well (step 140). In general, the reservoir quality index parameter of a well represents reservoir static parameters that can affect the flow of hydrocarbons. Flow through a formation can be represented by Darcy's Equation and integrating Darcy's Equation provides the following expression (Eq. 1) for the reservoir quality index at specific locations:

$$RQI=K*h*P/\mu \qquad \text{Eq. (1)}$$

where RQI is the reservoir quality index, K is the permeability of the formation, h is the thickness of the formation, P is the initial reservoir pressure, and μ is the viscosity of a fluid. The permeability can be calculated as a function of pore size in the formation determined from scanning electron microscope images collected, for example, with wireline logs and advanced nuclear magnetic resonance (NMR) techniques. Well logs can include scanning electron microscope images of the formation and a mean T2 cutoff generated using nuclear magnetic resonance techniques that classifies the pore density of the formation. Equation 1 provides that an accurate prediction of reservoir quality index parameter incorporating these fluid properties.

A reservoir quality index map is created based on the calculated reservoir quality index parameter for each well (step 141). The RQI map can be generated using a simple kriging method interpolating wells trended by seismic amplitude map.

Figure 5:
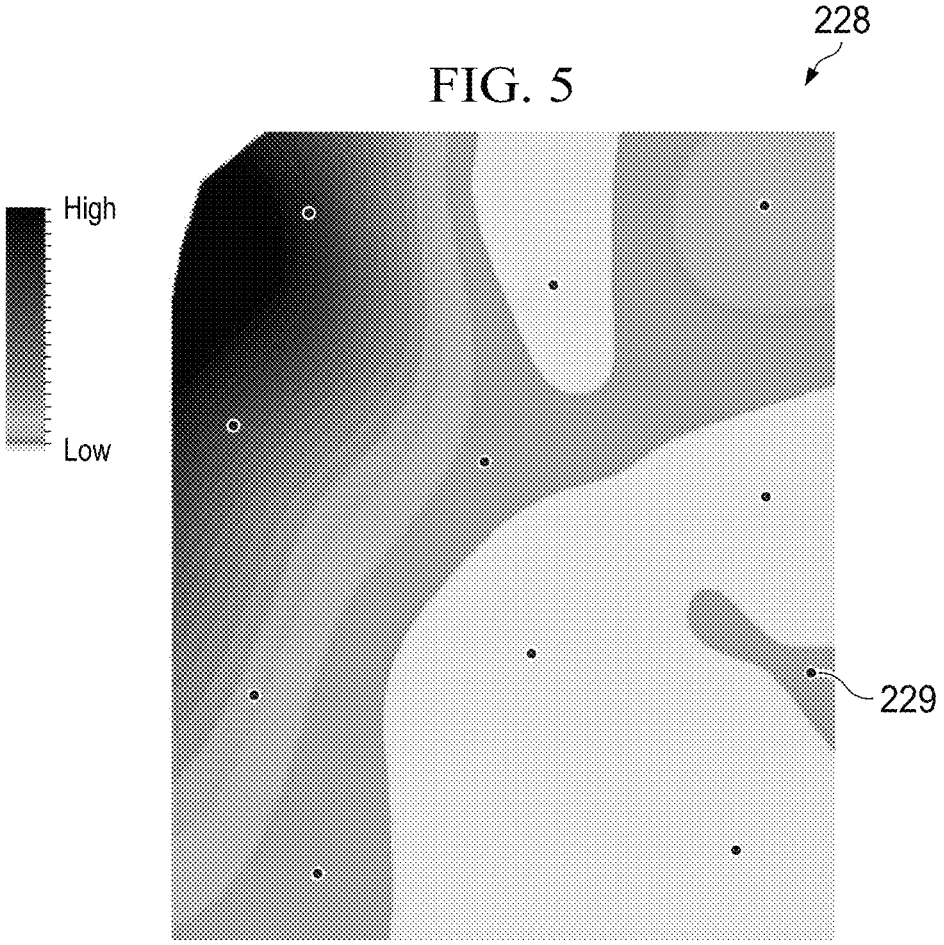
FIG. 5 is an example of reservoir quality index map.

FIG. 5 is an example of a reservoir quality index map 228. The data represented in FIGS. 4A-4B was used to calculate the reservoir quality index parameter for individual wells 229 in this basin. The calculated reservoir quality index parameter for individual wells 229 is interpolated to generate reservoir quality index map 228. In this basin, the reservoir quality is higher in the northwestern region of the basin relative to other portions of the basin. For example, relative values of the entire area are considered when decision is to be made whether or not to proceed with a development of a basin.

Figure 6:
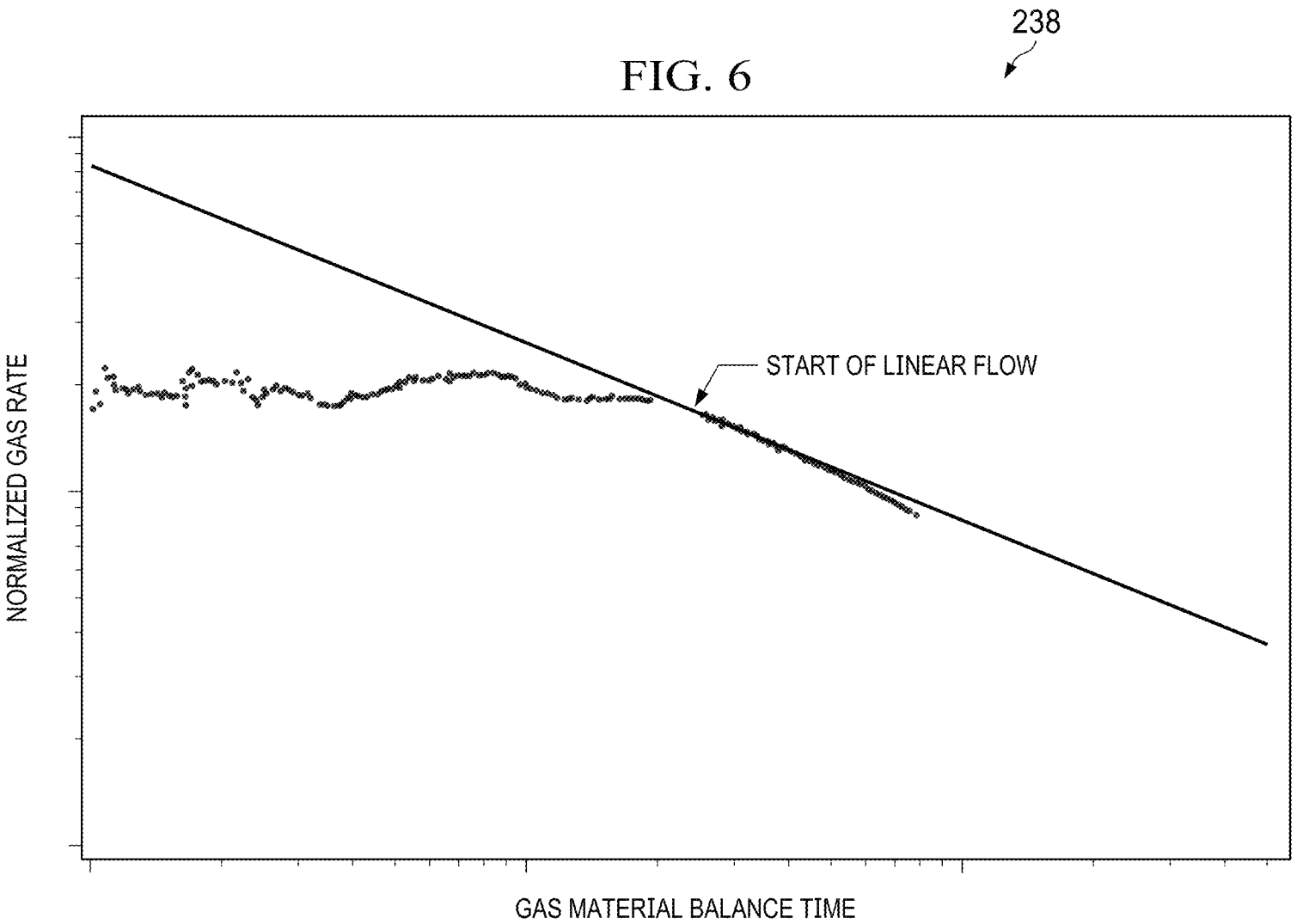
FIG. 6 illustrates a log-log diagnostic chart used in calculating the linear flow parameter for a well.

FIG. 6 illustrates a log-log diagnostic chart 238 used in calculating the linear flow parameter for a well 102. As illustrated, chart 238 represents examples of data related to the previously drilled wells which may be used to calculate the Linear Flow Parameter (LFP) for the one or more wells as described with respect to the step 142 of method 134. Log-log chart 238 shows the relationship between the normalized rate and the gas material balance time. The Y-axis indicates normalized gas rate (e.g., gas rate divided by pressure drawdown), and the X-axis indicates gas material balance time (e.g., cumulative gas divided by gas flow rate). The plot 238 is a logarithmic plot. In some implementations, the chart 238 is used to identify gas flow regimes. After an initial well cleanup, the flow regime for a multi-fracture horizontal well completed in an unconventional shale reservoir is expected to be a linear flow. The data points represent the normalized gas rate over time, and then the point at the "Start of Linear Flow" mark represents the start of a linear flow. The linear flow regime can be identified by a negative one half slope line in the log-log plot 238.

Figure 7:
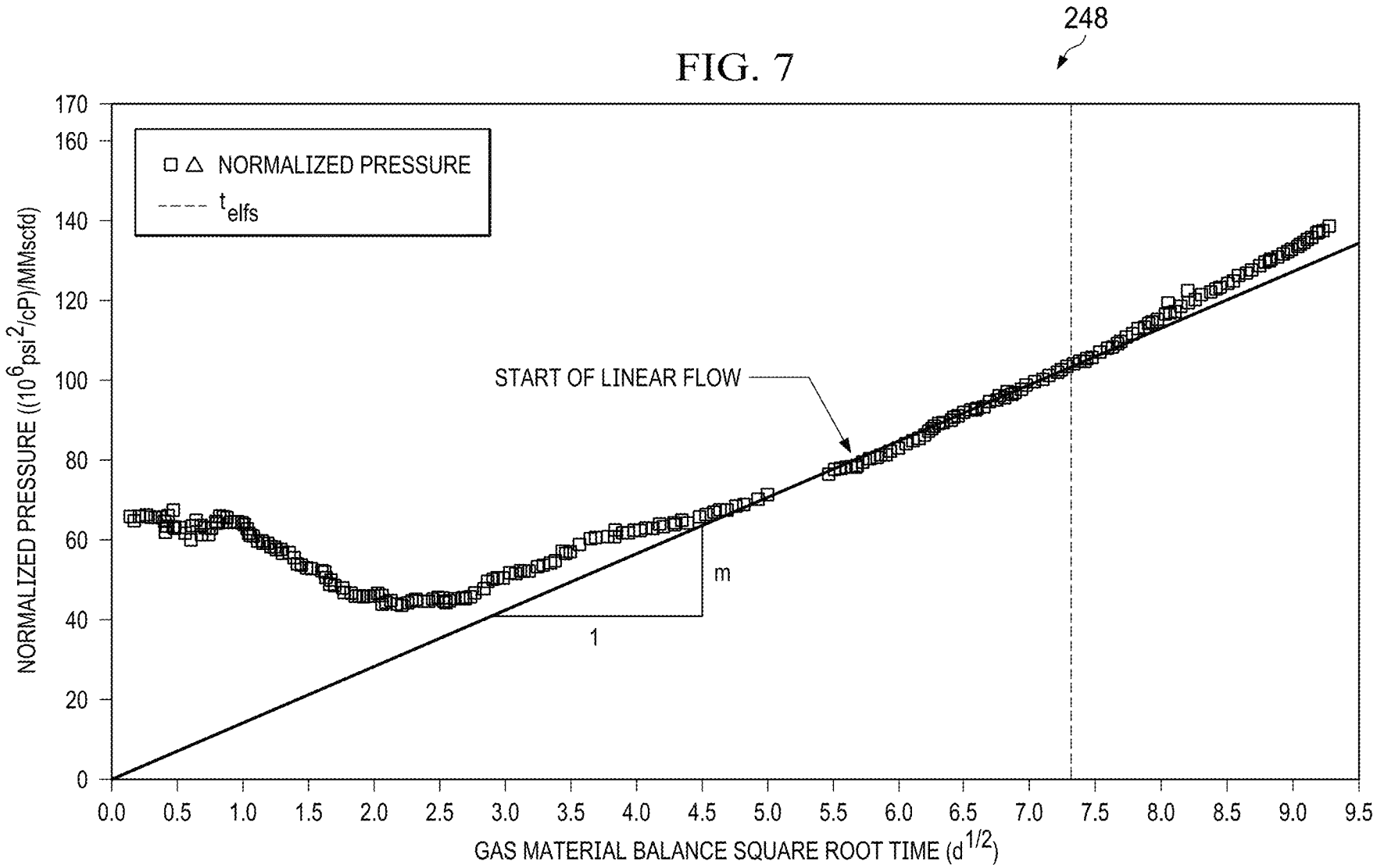
FIG. 7 illustrates data used in calculating the linear flow parameter for a well.

FIG. 7 illustrates data used in calculating the linear flow parameter for a well 102 from the flowback/production data. The chart 248 represents the relationship between the gas normalized pressure, along the Y-axis, and the square root of gas material balance time along the X-axis. The normalized pressure is the difference between initial reservoir pressure and the instantaneous bottom-hole flowing pressure divided by instantaneous flow rate. The material balance time is the instantaneous cumulative production divided by instantaneous flow rate. The data points in chart 248 show the normalized gas pressure being linear at the "Start of Linear Flow" mark. The slope of the linear portion of the data yields gas Linear Flow Parameter (LFP). The linear flow parameter can be calculated using an expression such as Equation 2:

$$LFP = A\sqrt{k} = \frac{630.8\ T}{\sqrt[m]{(\varphi\mu_g c_t)_i}} \qquad \text{Eq. (2)}$$

where m may represent the slope of the square root-time plot, T, in °R, may represent the temperature of the reservoir, Ø, in fraction, may represent the porosity of the reservoir, $\mu_g$, in centipoise, may represent the viscosity of the gas, and $C_t$, in $psi^{-1}$, may represent the total compressibility of the gas. More generally, $A_c$, in $ft^2$, may represent the area of flow of the gas, and k, in md, may represent the permeability value of the gas.

After the linear flow parameter is estimated, the estimated linear flow parameter and reservoir quality index parameter data are correlated (step 144).

Figure 8:
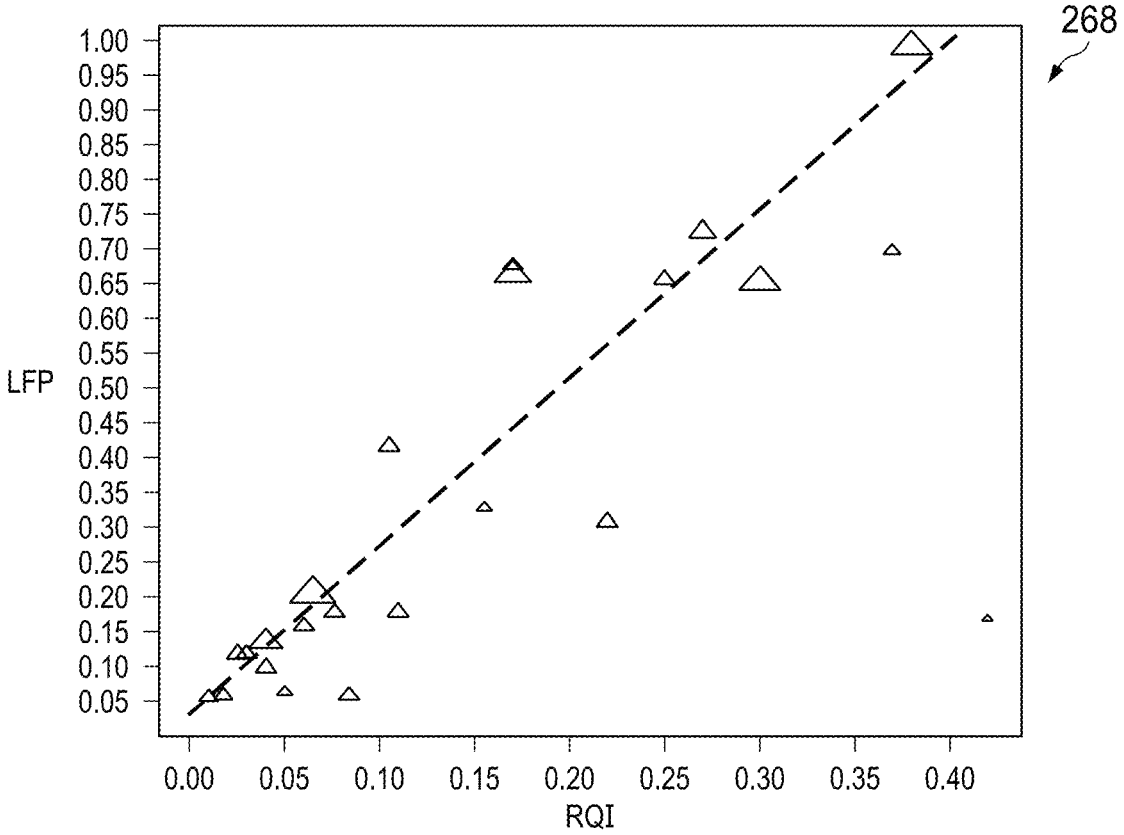
FIG. 8 is a plot of reservoir quality index map against linear flow potential for multiple wells.

FIG. 8 is a plot 268 of reservoir quality against linear flow potential for 23 wells. The size of the triangle for an individual is based on the lateral length of that well. A linear regression was determined using a working database (e.g., Spotfire) based on a numerical correlation between reservoir quality index and linear flow potential for this basin.

Potential development opportunities (for example, potential development opportunities identified by factors such as high RQI, or surface restrictions) are located on the reservoir quality index map 228 (step 146) allowing a reservoir quality index parameter to be assigned to each development opportunity. The correlation between reservoir quality index parameter and the linear flow parameter is used to convert the reservoir quality index parameter to a linear flow parameter for each development opportunity. The development opportunities are ranked based on their linear flow potential (step 148). The described method allows efficient drilling program to be used by prioritizing the areas with relatively high RQI, predicting the reservoir performance before drilling and completing the wells, and use of development plan in order to achieve the production target.

Figure 9:
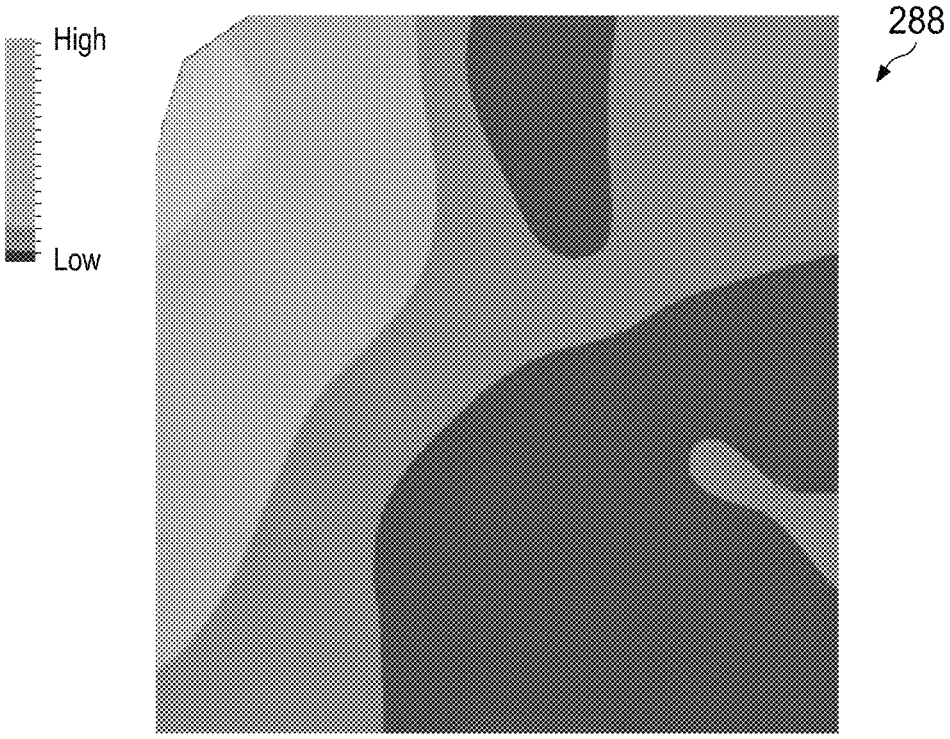
FIG. 9 shows an example of a basin ranking map.

FIG. 9 shows an example of a basin ranking map 288 in which the correlation developed as described with reference to FIG. 7 was used to convert the reservoir quality index map 228 to a map showing the linear flow potential across the basin. This basin ranking map 288 can also be used to identify sweet spots to be considered as potential development opportunities.

Figure 10:
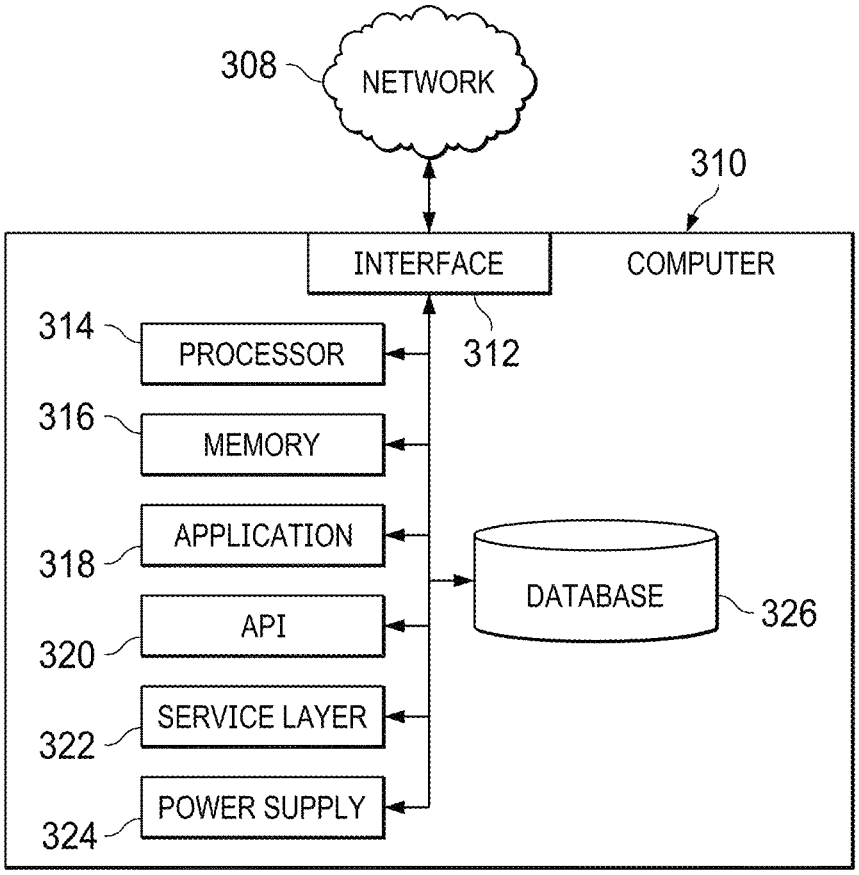
FIG. 10 is a block diagram of an example computer system.

FIG. 10 is a block diagram of an example computer system 310 used to provide computational functionalities associated with described algorithms, methods, functions, processes, flows, and procedures described in the present disclosure, according to some implementations of the present disclosure. The illustrated computer 310 is intended to encompass any computing device such as a server, a desktop computer, a laptop/notebook computer, a wireless data port, a smartphone, a personal data assistant (PDA), a tablet computing device, or one or more processors within these devices, including physical instances, virtual instances, or both. The computer 310 can include input devices such as keypads, keyboards, and touch screens that can accept user information. Also, the computer 310 can include output devices that can convey information associated with the operation of the computer 310 The information can include digital data, visual data, audio information, or a combination of information. The information can be presented in a graphical user interface (UI) (or GUI).

The computer 310 can serve in a role as a client, a network component, a server, a database, a persistency, or components of a computer system for performing the subject matter described in the present disclosure. The illustrated computer 310 is communicably coupled with a network 308. In some implementations, one or more components of the computer 310 can be configured to operate within different environments, including cloud-computing-based environments, local environments, global environments, and combinations of environments.

At a high level, the computer 310 is an electronic computing device operable to receive, transmit, process, store, and manage data and information associated with the described subject matter. According to some implementations, the computer 310 can also include, or be communicably coupled with, an application server, an email server, a web server, a caching server, a streaming data server, or a combination of servers.

The computer 310 can receive requests over network 308 from a client application (for example, executing on another computer 310). The computer 310 can respond to the received requests by processing the received requests using software applications. Requests can also be sent to the computer 310 from internal users (for example, from a command console), external (or third) parties, automated applications, entities, individuals, systems, and computers. Each of the components of the computer 310 can communicate using a system bus 564. In some implementations, any or all of the components of the computer 310, including hardware or software components, can interface with each other or the interface 312 (or a combination of both), over the system bus 564. Interfaces can use an application programming interface (API) 320, a service layer 322, or a combination of the API 320 and service layer 322. The API 320 can include specifications for routines, data structures, and object classes. The API 320 can be either computer-language independent or dependent. The API 320 can refer to a complete interface, a single function, or a set of APIs.

The service layer 322 can provide software services to the computer 310 and other components (whether illustrated or not) that are communicably coupled to the computer 310. The functionality of the computer 310 can be accessible for all service consumers using this service layer. Software services, such as those provided by the service layer 322, can provide reusable, defined functionalities through a defined interface. For example, the interface can be software written in JAVA, C++, or a language providing data in extensible markup language (XML) format. While illustrated as an integrated component of the computer 310, in alternative implementations, the API 320 or the service layer 322 can be stand-alone components in relation to other components of the computer 310 and other components communicably coupled to the computer 310. Moreover, any or all parts of the API 320 or the service layer 322 can be implemented as child or sub-modules of another software module, enterprise application, or hardware module without departing from the scope of the present disclosure.

The computer 310 includes an interface 312. Although illustrated as a single interface 312 in FIG. 10, two or more interfaces 312 can be used according to particular needs, desires, or particular implementations of the computer 310 and the described functionality. The interface 312 can be used by the computer 310 for communicating with other systems that are connected to the network 308 (whether illustrated or not) in a distributed environment. Generally, the interface 312 can include, or be implemented using, logic encoded in software or hardware (or a combination of software and hardware) operable to communicate with the network 308. More specifically, the interface 312 can include software supporting one or more communication protocols associated with communications. As such, the network 308 or the interface's hardware can be operable to communicate physical signals within and outside of the illustrated computer 310.

The computer 310 includes a processor 314. Although illustrated as a single processor 314 in FIG. 10, two or more processors 314 can be used according to particular needs, desires, or particular implementations of the computer 310 and the described functionality. Generally, the processor 314 can execute instructions and can manipulate data to perform the operations of the computer 310, including operations using algorithms, methods, functions, processes, flows, and procedures as described in the present disclosure.

The computer 310 also includes a database 326 that can hold data for the computer 310 and other components connected to the network 308 (whether illustrated or not). For example, database 326 can be an in-memory, conventional, or a database storing data consistent with the present disclosure. In some implementations, database 326 can be a combination of two or more different database types (for example, hybrid in-memory and conventional databases) according to particular needs, desires, or particular implementations of the computer 310 and the described functionality. Although illustrated as a single database 326 in FIG. 10, two or more databases (of the same, different, or combination of types) can be used according to particular needs, desires, or particular implementations of the computer 310 and the described functionality. While database 326 is illustrated as an internal component of the computer 310, in alternative implementations, database 326 can be external to the computer 310.

The computer 310 also includes a memory 316 that can hold data for the computer 310 or a combination of components connected to the network 308 (whether illustrated or not). Memory 316 can store any data consistent with the present disclosure. In some implementations, memory 316 can be a combination of two or more different types of memory (for example, a combination of semiconductor and magnetic storage) according to particular needs, desires, or particular implementations of the computer 310 and the described functionality. Although illustrated as a single memory 316 in FIG. 10, two or more memories 316 (of the same, different, or combination of types) can be used according to particular needs, desires, or particular implementations of the computer 310 and the described functionality. While memory 316 is illustrated as an internal component of the computer 310, in alternative implementations, memory 316 can be external to the computer 310.

The application 318 can be an algorithmic software engine providing functionality according to particular needs, desires, or particular implementations of the computer 310 and the described functionality. For example, application 318 can serve as one or more components, modules, or applications. Further, although illustrated as a single application 318, the application 318 can be implemented as multiple applications 318 on the computer 310. In addition, although illustrated as internal to the computer 310, in alternative implementations, the application 318 can be external to the computer 310.

The computer 310 can also include a power supply 324. The power supply 324 can include a rechargeable or non-rechargeable battery that can be configured to be either user- or non-user-replaceable. In some implementations, the power supply 324 can include power-conversion and management circuits, including recharging, standby, and power management functionalities. In some implementations, the power-supply 324 can include a power plug to allow the computer 310 to be plugged into a wall socket or a power source to, for example, power the computer 310 or recharge a rechargeable battery.

There can be any number of computers 310 associated with, or external to, a computer system containing computer 310, with each computer 310 communicating over network 308. Further, the terms "client," "user," and other appropriate terminology can be used interchangeably, as appropriate, without departing from the scope of the present disclosure.

Moreover, the present disclosure contemplates that many users can use one computer 310 and one user can use multiple computers 310.

Implementations of the subject matter and the functional operations described in this specification can be implemented in digital electronic circuitry, intangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially-generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of these systems and methods have been described. Nevertheless, it will be understood that various modifications may be made without departing from the spirit and scope of this disclosure. Accordingly, other embodiments are within the scope of the following claims.

What is claimed is:

1. A method for determining sweet spots in a subterranean formation, the method comprising:

drilling a plurality of wellbores in the subterranean formation using a drill tool;

measuring at least a permeability and a fluid viscosity of each of the plurality of wellbores by lowering a logging tool in each of the plurality of wellbores to collect measurements using the logging tool;

generating petrophysical logs of the plurality of wellbores based on at least the permeability and the fluid viscosity of each of the plurality of wellbores;

calculating a reservoir quality index parameter for each wellbore of the plurality of wellbores based on the permeability and the fluid viscosity of each respective wellbore from the petrophysical logs;

creating a reservoir quality index map using the petrophysical logs;

calculating a linear flow index parameter for each wellbore of the plurality of wellbores based on production data provided by the petrophysical logs;

correlating the reservoir quality index parameter and the linear flow index parameter for each wellbore of the plurality of wellbores to locate sweet spots; and ranking a basin based on the located sweet spots and the correlated parameters.

2. The method of claim 1, wherein calculating the reservoir quality index parameter further comprises characterizing the subterranean formation in each wellbore for permeability, thickness, and pressure.

3. The method of claim 2, wherein characterizing the subterranean formation includes taking into effect flow characteristics of hydrocarbons and the measured fluid viscosity.

4. The method of claim 2, wherein calculating the reservoir quality index parameter is based on Darcy equation.

5. The method of claim 1, wherein creating the reservoir quality index map further comprises correlating pore size and density with the measured permeability of the subterranean formation of the plurality of wellbores based on the petrophysical logs and scanning electron microscope images.

6. The method of claim 1, wherein calculating the linear flow index parameter further comprises correlating flow characteristics in the subterranean formation of the plurality of wellbores by observing the production data and a bottom-hole flowing pressure data.

7. The method of claim 6, wherein the correlating the reservoir quality index parameter and the linear flow index parameter includes determining potential development opportunities.

8. The method of claim 7, wherein the correlating the reservoir quality index parameter and the linear flow index parameter further comprises ranking the basin.

9. The method of claim 8, wherein ranking the basin includes three main limits as criteria to classify a production performance of the plurality of wellbores.

10. The method of claim 1, wherein calculating the linear flow index parameter further comprises calculating a dynamic flow capacity of the plurality of wellbores.

11. A method for ranking a basin, the method comprising:

measuring at least a permeability and a fluid viscosity of each of a plurality of wellbores by lowering a logging tool in each of the plurality of wellbores to collect measurements using the logging tool;

generating petrophysical logs of the plurality of wellbores based on at least the permeability and the fluid viscosity of each of the plurality of wellbores;

calculating a reservoir quality index parameter for each wellbore of the plurality of wellbores based on the permeability and the fluid viscosity of each respective wellbore from the petrophysical logs;

creating a reservoir quality index map;

calculating a linear flow index parameter for each wellbore of the plurality of wellbores based on production data;

correlating the reservoir quality index parameter and the linear flow index parameter for each wellbore of the plurality of wellbores to locate sweet spots; and ranking the basin based on the located sweet spots and the correlated parameters.

12. The method of claim 11, wherein calculating the reservoir quality index parameter further comprises characterizing a formation in each wellbore for permeability, thickness, and pressure.

13. The method of claim 12, wherein characterizing the formation includes taking into effect the flow characteristics of hydrocarbons and the measured fluid viscosity.

14. The method of claim 12, wherein calculating the reservoir quality index parameter is based on Darcy equation.

15. The method of claim 11, wherein creating the reservoir quality index map further comprises correlating pore size and density with the measured permeability of the formation of the plurality of wellbores based on the petrophysical logs and scanning electron microscope images.

16. The method of claim 11, wherein calculating the linear flow index parameter further comprises correlating flow characteristics in the formation of the plurality of wellbores by observing the production data and a bottom-hole flowing pressure data.

17. The method of claim 16, wherein the correlating the reservoir quality index parameter and the linear flow index parameter includes determining potential development opportunities.

18. The method of claim 17, wherein the correlating the reservoir quality index parameter and the linear flow index parameter further comprises ranking the basin.

19. The method of claim 18, wherein ranking the basin includes three main limits as criteria to classify a production performance of the plurality of wellbores.

20. The method of claim 11, wherein calculating the linear flow index parameter further comprises calculating a dynamic flow capacity of the plurality of wellbores.

* * * * *